US010509340B2

(12) United States Patent
Kim et al.

(10) Patent No.: US 10,509,340 B2
(45) Date of Patent: Dec. 17, 2019

(54) IMAGE FORMING APPARATUS AND METHOD FOR COLOR REGISTRATION CORRECTION

(71) Applicant: HP PRINTING KOREA CO., LTD., Suwon-si, Gyeonggi-do (KR)

(72) Inventors: Youn-jae Kim, Yongin-si (KR); Ki-youn Lee, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 67 days.

(21) Appl. No.: 15/476,053

(22) Filed: Mar. 31, 2017

(65) Prior Publication Data

US 2018/0107132 A1 Apr. 19, 2018

(30) Foreign Application Priority Data

Oct. 17, 2016 (KR) ..... 10-2016-0134293

(51) Int. Cl.
*B41J 2/385* (2006.01)
*G03G 15/01* (2006.01)
*G03G 15/00* (2006.01)

(52) U.S. Cl.
CPC ..... *G03G 15/0142* (2013.01); *G03G 15/0131* (2013.01); *G03G 15/5062* (2013.01); *G03G 2215/0161* (2013.01)

(58) Field of Classification Search
None
See application file for complete search history.

(56) References Cited

U.S. PATENT DOCUMENTS

| | | | | |
|---|---|---|---|---|
| 5,461,462 | A | 10/1995 | Nakane et al. | |
| 6,118,463 | A | 9/2000 | Houki et al. | |
| 6,198,490 | B1 | 3/2001 | Eom et al. | |
| 8,136,904 | B2 | 3/2012 | Eom | |
| 2002/0027590 | A1 | 3/2002 | Enami | |
| 2002/0180996 | A1 | 12/2002 | Allen et al. | |
| 2004/0101768 | A1 | 5/2004 | Wiliams | |
| 2005/0073703 | A1 | 4/2005 | Nakane | |
| 2005/0206982 | A1 | 9/2005 | Hattori | |
| 2007/0030300 | A1 | 2/2007 | Jeong | |
| 2007/0053727 | A1 | 3/2007 | Goto | |
| 2008/0068439 | A1 | 3/2008 | Koshimura et al. | |
| 2009/0067860 | A1 | 3/2009 | Sakai et al. | |
| 2010/0060938 | A1 * | 3/2010 | Kondoh | G03G 15/161 358/3.13 |
| 2010/0149564 | A1 * | 6/2010 | Yasunaga | H04N 1/4015 358/1.9 |

(Continued)

FOREIGN PATENT DOCUMENTS

| | | | |
|---|---|---|---|
| EP | 1 260 877 | A1 | 11/2002 |
| EP | 1 422 274 | A1 | 5/2004 |

(Continued)

*Primary Examiner* — Thomas D Lee
(74) *Attorney, Agent, or Firm* — Staas & Halsey LLP

(57) ABSTRACT

An image forming apparatus includes an image former to print on a printing paper a plurality of lines that are arranged at intervals in a main scanning direction and are vertical to the main scanning direction using different photosensitive drums, a scanner is to scan the printing paper on which the plurality of lines are printed to obtain a scanned image usable in a color registration correction.

20 Claims, 15 Drawing Sheets

(56) References Cited

U.S. PATENT DOCUMENTS

| | | | | |
|---|---|---|---|---|
| 2013/0064580 | A1* | 3/2013 | Igarashi | G03G 15/0189 399/301 |
| 2014/0153975 | A1 | 6/2014 | Lee | |
| 2016/0320861 | A1 | 11/2016 | Yoshida | |

FOREIGN PATENT DOCUMENTS

| | | | |
|---|---|---|---|
| EP | 2739031 | A2 | 6/2014 |
| JP | 6-98153 | | 4/1994 |
| JP | 6-194918 | | 7/1994 |
| JP | 9-107487 | | 4/1997 |
| JP | 9-214793 | | 8/1997 |
| JP | 10-271337 | | 10/1998 |
| JP | 3079076 | | 12/1998 |
| JP | 2000-255101 | | 9/2000 |
| JP | 2001-127968 | | 5/2001 |
| JP | 2001-277673 | | 10/2001 |
| JP | 2002-156801 | | 5/2002 |
| JP | 2003-34055 | | 2/2003 |
| JP | 2003-35599 | | 2/2003 |
| JP | 2004-12699 | | 1/2004 |
| JP | 2004-170989 | | 6/2004 |
| JP | 2004-357017 | | 12/2004 |
| JP | 2005-18019 | | 1/2005 |
| JP | 2005-117667 | | 4/2005 |
| JP | 2005-191804 | | 7/2005 |
| JP | 2005-260305 | | 9/2005 |
| JP | 2006-35460 | | 2/2006 |
| JP | 2006-41906 | | 2/2006 |
| JP | 2006-81010 | | 3/2006 |
| JP | 2006-171471 | | 6/2006 |
| JP | 2006-259073 | | 9/2006 |
| JP | 2007-22060 | | 2/2007 |
| JP | 2007-33550 | | 2/2007 |
| JP | 2008-28662 | | 2/2008 |
| JP | 2008-73867 | | 4/2008 |
| JP | 2008-152745 | | 7/2008 |
| JP | 2008-152746 | | 7/2008 |
| JP | 2009-10571 | | 1/2009 |
| JP | 2012-211962 | | 11/2012 |
| JP | 5819623 | | 11/2012 |
| KR | 10-0338744 | | 5/2000 |
| KR | 10-0717018 | | 2/2007 |
| KR | 10-2007-0052058 | | 5/2007 |
| KR | 10-2008-0070199 | | 7/2008 |
| KR | 10-2014-0070090 | | 6/2014 |

* cited by examiner

IMAGE FORMING APPARATUS AND METHOD FOR COLOR REGISTRATION CORRECTION

CROSS-REFERENCE TO RELATED APPLICATIONS

This application claims priority from Korean Patent Application No. 10-2016-0134293 filed on Oct. 17, 2016 in the Korean Intellectual Property Office, the disclosure of which is incorporated herein by reference in its entirety.

BACKGROUND

1. Field

The present disclosure relates to an image forming apparatus and a method for color registration correction, and more particularly, to an image forming apparatus and a method for color registration correction, which can compensate for a difference in position between colors in a main scanning direction.

2. Description of the Related Art

In general, an image forming apparatus means an apparatus that prints on a recording paper print data that is generated in a print control terminal device, such as a computer. Examples of such an image forming apparatus may include a copy machine, a printer, a facsimile, and an MFP (Multi-Function Peripheral) that has multiple functions of the above-described devices in one unit.

In general, an electro photographic printing device, such as a color laser printer, is configured to include four photosensitive drums Dy, Dc, Dm, and Dk prepared to correspond to four kinds of colors of yellow, cyan, magenta, and black, an exposure device configured to form an electrostatic latent image of a desired image through scanning of light onto the respective photosensitive drums Dy, Dc, Dm, and Dk, a development device configured to develop the electrostatic latent image with developing solutions for the above-described colors, and a transfer belt (or middle transfer belt) which forms a color image that is completed through transfer of successively overlapping images that are developed on the respective photosensitive drums Dy, Dc, Dm, and Dk, and transfers the color image onto a printing paper.

Accordingly, in order to print one desired color image, a final color image is made by developing respective color images on four photosensitive drums Dy, Dc, Dm, and Dk and imprinting the developed color images so that they overlap one another on the same image position of the transfer belt, and the final color image is then printed on the printing paper.

However, in order to accurately make a desired color image through overlapping of the four kinds of colors on the same image position of the transfer belt, it is required to match transfer start positions and transfer end positions of the four kinds of color images that are transferred from the respective photosensitive drums Dy, Dc, Dm, and Dk onto the transfer belt. This is because if the developed color images are transferred onto the transfer belt with their positions slightly mismatched although all of them have been clearly developed on the respective photosensitive drums Dy, Dc, Dm, and Dk, the finally obtained color image is unable to present accurate colors and images.

Accordingly, in order to accurately implement a color image, it is important to accurately match the exposure start time points of the respective photosensitive drums Dy, Dc, Dm, and Dk through the exposure device, and such matching of plural colors to form one image so that the colors accurately overlap one another is called color registration.

Such color registration is normally performed using a registration sensor that is provided in an image forming apparatus. The registration sensor is configured to measure whether an image alignment is erroneous by scanning light with respect to a registration pattern that is developed on an image forming medium and sensing the light that is reflected from the registration pattern.

However, such a method that uses the registration sensor is useful to align the error of the image alignment in a sub-scanning direction, but has the problem that it is unable to accurately align the error of the image alignment in a main scanning direction. Specifically, even if the exposure start time points of the respective photosensitive drums accurately coincide with one another, pixel positions in the main scanning direction may not be uniform for the respective colors, and thus the error of the image alignment may occur in the main scanning direction.

However, in the case of using the registration sensor, the alignment is performed at two or three limited main-scanning positions, and thus it is limited to perform an accurately registration alignment at the overall positions in the main scanning direction.

In order to overcome such limits, it is required to arrange a large number of registration sensors in the main scanning direction. In this case, however, the manufacturing cost of the image forming apparatus is considerably increased, and there is a limit in the number of registration sensors that can be arranged due to the physical sizes of the registration sensors.

Accordingly, there has been a need for a method that can reduce the error of the image alignment in the main scanning direction even without using the registration sensors.

SUMMARY

Exemplary embodiments of the present disclosure overcome the above disadvantages and other disadvantages not described above, and provide an image forming apparatus and a method for color registration correction, which can compensate for a difference in position between colors in a main scanning direction.

According to an aspect of the present disclosure, an image forming apparatus includes an image former configured to print on a printing paper a plurality of lines which are arranged at predetermined intervals in a main scanning direction and are vertical to the main scanning direction at predetermined intervals of sub-scanning using different photosensitive drums; a scanner configured to scan the printing paper on which the plurality of lines are printed; and a processor configured to perform color registration correction using the scanned image.

The processor may perform the registration correction for the different photosensitive drums for a plurality of positions in the main scanning direction that correspond to the plurality of lines using the scanned image.

The image former including a plurality of photosensitive drums and configured to print, on a printing paper, a plurality of lines that are arranged at predetermined intervals along a main scanning direction of the image former and are vertical to the main scanning direction, each of the plurality of lines including sub-lines, which are arranged along a sub-scanning direction perpendicular to the main scanning direction and at least two of which are printed using a different respective one of the plurality of photosensitive drums.

Each of the plurality of lines may be composed of 5 sub-lines, the respective sub-lines include first to fifth sub-lines sequentially arranged along the sub-scanning direction, and the image former prints the first and fifth sub-lines on the printing paper using a same photosensitive drum among the plurality of photosensitive drums.

The processor may calculate skew values of the plurality of lines using the first and fifth sub-lines, and may perform the registration correction for the different photosensitive drums.

The first and fifth sub-lines may be formed by the photosensitive drum that corresponds to a black color.

The processor may sense errors with respect to the different sub-lines on the basis of the first and fifth sub-lines, and may correct irradiation positions of photo sensors that correspond to C, M, and Y colors, respectively, for a plurality of positions in the main scanning direction that correspond to the plurality of lines on the basis of the sensed errors.

The image former may print horizontal lines which come in contact with upper portions and lower ends of the plurality of lines and are vertical to the sub-scanning direction.

The plurality of lines may be 49 lines.

The number of the plurality of lines may be determined in a unit that can adjust timing of an exposure device and in a sampling number.

The sampling number may be a natural number in the range of 1 to 8.

The image former may print a predetermined shape at a position that is spaced apart from the plurality of lines.

The image former may print at least one of an English sentence, a figure, and a barcode, which can identify the image forming apparatus, together with the plurality of lines.

According to another aspect of the present disclosure, a method for color registration includes printing on a printing paper, a plurality of lines that are arranged at predetermined intervals along a main scanning direction of the image former and are vertical to the main scanning direction, each of the plurality of lines including sub-lines, which are arranged along a sub-scanning direction perpendicular to the main scanning direction and at least two of which are printed using a different respective one of the plurality of photosensitive drums; a scanner configured to scan the printing paper, on which the plurality of lines are printed, to obtain a scanned image of the plurality of lines; and at least one processor configured to perform color registration correction using the scanned image.

The performing the correction may perform the registration correction for the different photosensitive drums for a plurality of positions in the main scanning direction that correspond to the plurality of lines using the plurality of scanned lines.

Each of the plurality of lines may be composed of 5 sub-lines, and the printing may print first and fifth sub-lines on the printing paper using the same photosensitive drum.

The performing the registration correction may calculate skew values of the plurality of lines using the first and fifth sub-lines, and may perform the registration correction for the different photosensitive drums.

The first and fifth sub-lines may be formed by the photosensitive drum that corresponds to a black color.

The performing the registration correction may sense errors with respect to the different sub-lines on the basis of the first and fifth sub-lines, and may correct irradiation positions of photo sensors that correspond to C, M, and Y colors, respectively, for a plurality of positions in the main scanning direction that correspond to the plurality of lines on the basis of the sensed errors.

The printing may print horizontal lines which come in contact with upper portions and lower ends of the plurality of lines and are vertical to the sub-scanning direction.

The number of the plurality of lines may be determined in a unit that can adjust timing of an exposure device and in a sampling number.

Additional and/or other aspects and advantages of the disclosure will be set forth in part in the description which follows and, in part, will be obvious from the description, or may be learned by practice of the disclosure.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DESCRIPTION OF EMBODIMENTS

Hereinafter, various exemplary embodiments of the present disclosure will be described with reference to the accompanying drawings. However, it should be understood that the present disclosure is not limited to the specific embodiments described hereinafter, but includes various modifications, equivalents, and/or alternatives of the embodiments of the present disclosure. In describing the embodiments, well-known related technologies are not described in detail since they would obscure the disclosure in unnecessary detail.

On the other hand, the term "connected to" or "coupled to" that is used to designate a connection or coupling of one element to another element includes both a case that an element is "directly connected or coupled to" another element and a case that an element is connected or coupled to another element via still another element. Further, it should be understood that the term "includes" means that other constituent elements may be further included rather than excluding the other constituent elements unless specially mentioned on the contrary.

In the description, the term "image forming job" may mean various jobs (e.g., printing, scanning, and faxing) that are related to image forming or creation/storage/transmission of an image file, and the term "job" may mean not only an image forming job but also a series of all processes that are required to perform an image forming job.

Further, the term "image forming apparatus" may mean a device that prints print data that is generated from a terminal device, such as a computer, on a recording paper. Examples of such an image forming apparatus may include a copy machine, a printer, a facsimile, and an MFP (Multi-Function Peripheral) that has multiple functions of the above-described devices in one unit. The image forming apparatus may include all devices that can perform an image forming jobs, such as the printer, the scanner, the facsimile, the MFP, or a display device.

Further, the term "hard copy" may mean an operation to output an image onto a printing medium, such as a paper, and the term "soft copy" may mean an operation to output an image to a display device, such as a TV or a monitor.

Further, the term "content" may mean all kinds of data that is an object of mage forming job, such as a photo or a document file.

Further, the term "print data" may mean data that is converted into a printable format in a printer. On the other hand, if the printer supports direct printing, the file itself may become the print data.

Further, the term "user" may mean a person who performs an operation that is related to an image forming job using an image forming apparatus or a device that is connected to the image forming apparatus by wire or wirelessly. Further, the term "manager" may mean a person who has the right to access all functions of the image forming apparatus and the system. The manager and the user may be the same person.

Figure 1:
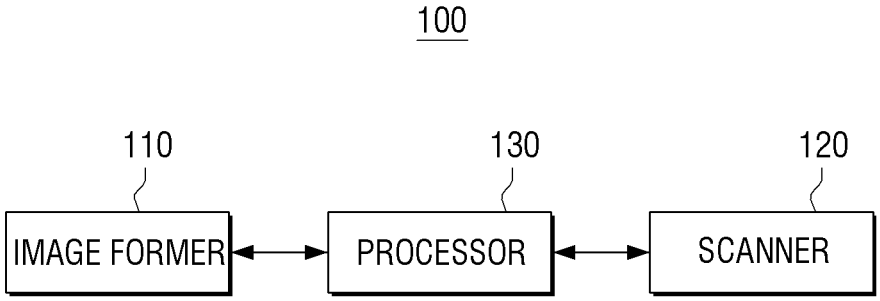
FIG. 1 is a block diagram schematically illustrating the configuration of an image forming apparatus according to an embodiment of the present disclosure.

FIG. 1 is a block diagram schematically illustrating the configuration of an image forming apparatus according to an embodiment of the present disclosure.

Referring to FIG. 1, an image forming apparatus 100 includes an image former 110, a scanner 120, and a processor 130.

The image former 110 prints print data. Specifically, the image former 110 prints print data that is received through a communication interface 140 to be described later.

Further, the image former 110 prints a color chart. Here, the color chart is a chart having a plurality of colors for performing color registration, and is obtained by printing a plurality of lines, which are arranged at predetermined intervals in a main scanning direction and are vertical to the main scanning direction, at predetermined intervals of sub-scanning using different photosensitive drums. The detailed shape of the color chart will be described later with reference to FIGS. 5 and 6. Further, the detailed configuration of the image former 110 will be described later with reference to FIG. 3.

The scanner 120 includes a lens that forms light that is reflected from a document on an image sensor in the scanner, and read image information of the document out of the light that is formed on the image sensor. Further, the scanner 120 scans the color chart, and provides the scanned color chart to the processor 130. On the other hand, the scanner 120 may be positioned on a flatbed or in a DADF (Duplex Automatic Document Feeder).

On the other hand, in this embodiment, although it is exemplified that the scanner 120 that is provided in the image forming apparatus 100 directly scans and uses the color chart, the color chart may be scanned through an external scanning device, and the scanned color chart may be received from the external scanning device using the communication interface 140.

The processor 130 controls respective constituent elements in the image forming apparatus 100. Specifically, the processor 130 may be implemented by a CPU or an ASIC. Specifically, in the case of receiving a registration command through an operation inputter 160, the processor 130 may control the image former 110 to print the color chart, and may control the scanner 120 to scan the printed color chart.

Further, the processor 130 may detect a plurality of lines from the scanned color chart, and may perform registration correction for different photosensitive drums for a plurality of positions in the main scanning direction that correspond to the plurality of lines using the scanned color chart. Specifically, with respect to the plurality of lines, the processor 130 senses errors in the main scanning direction between the first (i.e., K) or fifth (i.e., K) sub-line of a plurality of sub-lines (hereinafter, for convenience in explanation, it is assumed that each line is composed of sub-lines in the order of K, C, M, Y, and K colors) that constitute the plurality of lines and the remaining sub-lines C, M, and Y. Further, the processor 130 may perform color registration correction in the main scanning direction by correcting irradiation positions of photo sensors that correspond to C, M, and Y colors for a plurality of positions in the main scanning direction that correspond to the plurality of lines on the basis of the sensed errors.

In this case, the processor 130 may calculate the errors by calculating skews of the paper on the basis of the first and fifth sub-lines and reflecting the calculated skews therein. The processor 130 may sense the skews that may occur due to a crooked paper in a scanning process or rotation in the printing process through the two sub-lines as described above, and may calculate the errors in the main scanning direction between the sub-lines of different colors in consideration of the skews.

Further, if color registration in the sub-scanning direction is required, the processor 130 may perform the color registration correction in the sub-scanning direction using a color registration sensor (or ACR) that is in the image former 110. Since the correction using the color registration sensor is well-known technology, the detailed explanation thereof will be omitted.

Further, if the print data is received, the processor 130 may control the image former 110 to generate binary data through performing of processes, such as parsing, of the received print data and to print the generated binary data.

As described above, the image forming apparatus 100 according to this embodiment can correct the errors (i.e., errors due to non-linearity of an LSU optical system) in the main scanning direction, and thus it becomes possible to perform color printing with more improved image quality. Further, since the errors in the main scanning direction can be corrected without using the color registration sensor, the manufacturing cost of the image forming apparatus can be reduced.

On the other hand, although only a simple configuration that constitutes the image forming apparatus has been illustrated and described, various configurations may be additionally provided during implementation. This will be described hereinafter with reference to FIG. 2.

Figure 2:
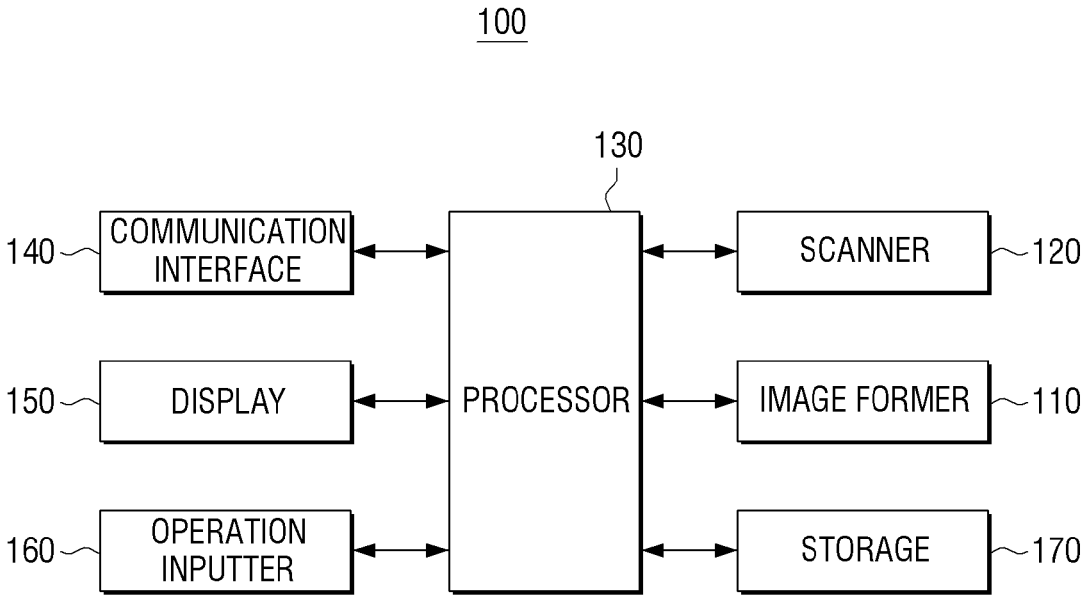
FIG. 2 is a block diagram illustrating the detailed configuration of an image forming apparatus according to an embodiment of the present disclosure.

FIG. 2 is a block diagram illustrating the detailed configuration of an image forming apparatus according to an embodiment of the present disclosure.

Referring to FIG. 2, the image forming apparatus 100 according to an embodiment of the present disclosure includes an image former 110, a scanner 120, a processor 130, a communication interface 140, a display 150, an operation inputter 160, and a storage 170. Here, the image forming apparatus 100 may be a copy machine, a printer, a facsimile, or an MFP (Multi-Function Peripheral) that has multiple functions of the above-described devices in one unit.

The image former 110, the scanner 120, and the processor 130 perform the same functions as those of the configurations of FIG. 1, and thus duplicate explanation thereof will be omitted.

The communication interface 140 is connected to a print control terminal device (not illustrated), and receives print data from the print control terminal device. Specifically, the communication interface 140 is formed to connect the image forming apparatus 100 to an external device, and may be connected to the terminal device through not only a LAN (Local Area Network) or the Internet but also a USB (Universal Serial Bus) port or a wireless communication (e.g., W-Fi 802.11a/b/g/n, NFC, or Bluetooth) port.

On the other hand, if the scanner 120 is not provided in the image forming apparatus 100, the communication interface 140 may receive a scanned image that corresponds to a scan chart that is scanned by a separate external device from the corresponding external device.

The display 150 displays thereon various kinds of information provided from the image forming apparatus 100. Specifically, the display 150 may display user interface windows for selecting various kinds of functions that are provided from the image forming apparatus 100. The display 150 may be a monitor, such as an LCD, a CRT, or an OLED, and may be implemented by a touch screen that can simultaneously perform the functions of the operation inputter 160 to be described later.

Further, the display 150 may display a control menu for performing functions of the image forming apparatus 100.

Further, the display 150 may display a manual that is necessary when the color registration is performed. For example, if a color chart is printed according to a color registration command, the display 150 may display a manual for requesting scanning of the printed color chart through the scanner 120.

If the scanner 120 is not provided in the image forming apparatus 100, the display 150 may display a manual for notifying that another scanning device should scan the currently printed color chart and transmit the scanned color chart to the image forming apparatus 100.

As described above, it is exemplified that the above-described manual is displayed on the image forming apparatus 100. However, if it is possible to operate the image forming apparatus 100 through a separate external device (e.g., smart phone), the image forming apparatus 100 may transmit information that corresponds to the above-described manual to the external device so that the manual is displayed on the external device.

The operation inputter 160 may receive an input of user's function selection and a control command for the corresponding function. Here, the function may include printing, copying, scanning, and fax transmission. The function control command as described above may be input through a control menu that is displayed on the display 150.

The operation inputter 160 may be implemented by a plurality of buttons, a keyboard, and a mouse, and may also be implemented by a touch screen that can simultaneously perform the function of the display 150.

Further, the color registration command may be input through the operation inputter 160. Further, during implementation, the color registration command may be input from an external device through the communication interface 140.

The storage 170 may store print data that is received through the communication interface 140. The storage 140 may be implemented by a storage medium in the image forming apparatus 100 or an external storage medium, for example, a removable disk including a USB memory, a storage medium connected to a host, or a web server through a network.

Further, the storage 170 stores image data that corresponds to the above-described color chart. Further, the storage 170 may store scanned images generated through the scanner 120.

Figure 3:
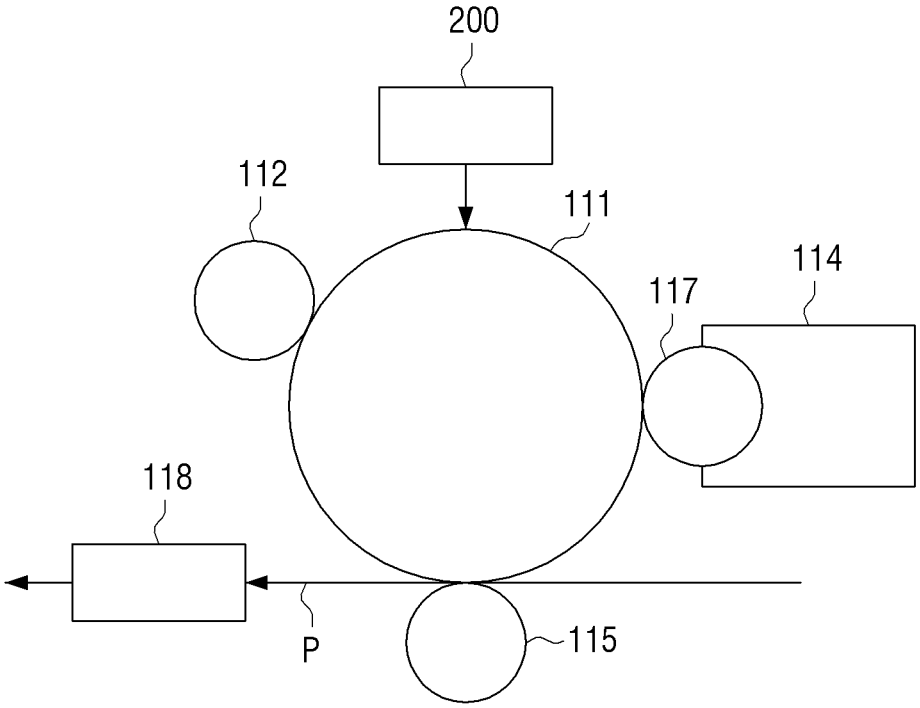
FIG. 3 is a diagram illustrating an image former of FIG. 1 according to an embodiment.

FIG. 3 is a diagram illustrating an image former of FIG. 1 according to an embodiment.

Referring to FIG. 3, the image former 110 may include a photosensitive drum 111, a charger 112, an exposure device 200, a developer 114, a transfer device 115, and a fuser 118.

The image former 110 may further include a feeding means (not illustrated) that feeds a recording medium P. An electrostatic latent image is formed on the photosensitive drum 111. The photosensitive drum 111 may be called a photoconductive drum or a photosensitive belt according to the shape thereof.

Hereinafter, for convenience in explanation, only the configuration of the image former 110 that corresponds to one color is exemplified. However, during implementation, the image former 110 may include a plurality of photosensitive drums 111 that correspond to a plurality of colors, a plurality of chargers 112, a plurality of exposure devices 200, and a plurality of developers 114.

The charger 112 charges the surface of the photosensitive drum 111 with uniform electric potential. The charger 112 may be implemented in the form of a corona charger, a charging roller, or a charging brush.

The exposure device 200 forms an electrostatic latent image on the surface of the photosensitive drum 11 through changing of the surface potential of the photosensitive drum 111 according to image information to be printed. As an example, the exposure device 200 may form an electrostatic latent image by irradiating the photosensitive drum 111 with light that is modulated according to the image information to be printed. The exposure device 200 as described above may be called an optical scanner, and LEDs may be used as a light source in the exposure device 200. The detailed configuration and operation of the exposure device 200 will be described later with reference to FIG. 4.

The developer 114 accommodates a developing agent therein, and develops the electrostatic latent image into a visible image through supply of the developing agent onto the electrostatic latent image. The developer 114 may include a developing roller 117 that supplies the developing agent onto the electrostatic latent image. For example, the developing agent may be supplied from the developing roller 117 onto the electrostatic latent image that is formed on the photosensitive drum 111 by a developing electric field that is formed between the developing roller 117 and the photosensitive drum 111.

The visible image that is formed on the photosensitive drum 111 is transferred onto the recording medium P by the transfer device 115 or a middle transfer belt (not illustrated). For example, the transfer device 115 may transfer the visible image onto the recording medium through an electrostatic transfer method.

The fuser 118 fuses the visible image on the recording medium P by applying heat and/or pressure to the visible image on the recording medium P. Through a series of processes as described above, the printing job is completed.

The above-described developer is used whenever the image forming job is performed, and thus is drained after it is used over a predetermined time. In this case, a unit (e.g., the developer 114) that stores the developing agent should be replaced by a new one. A component or constituent element that can be replaced in the process of using the image forming apparatus is called a consumable unit or a replaceable unit. Further, a memory (or CRUM chip) may be attached to such a consumable unit for proper management of the corresponding consumable unit.

Figure 4:
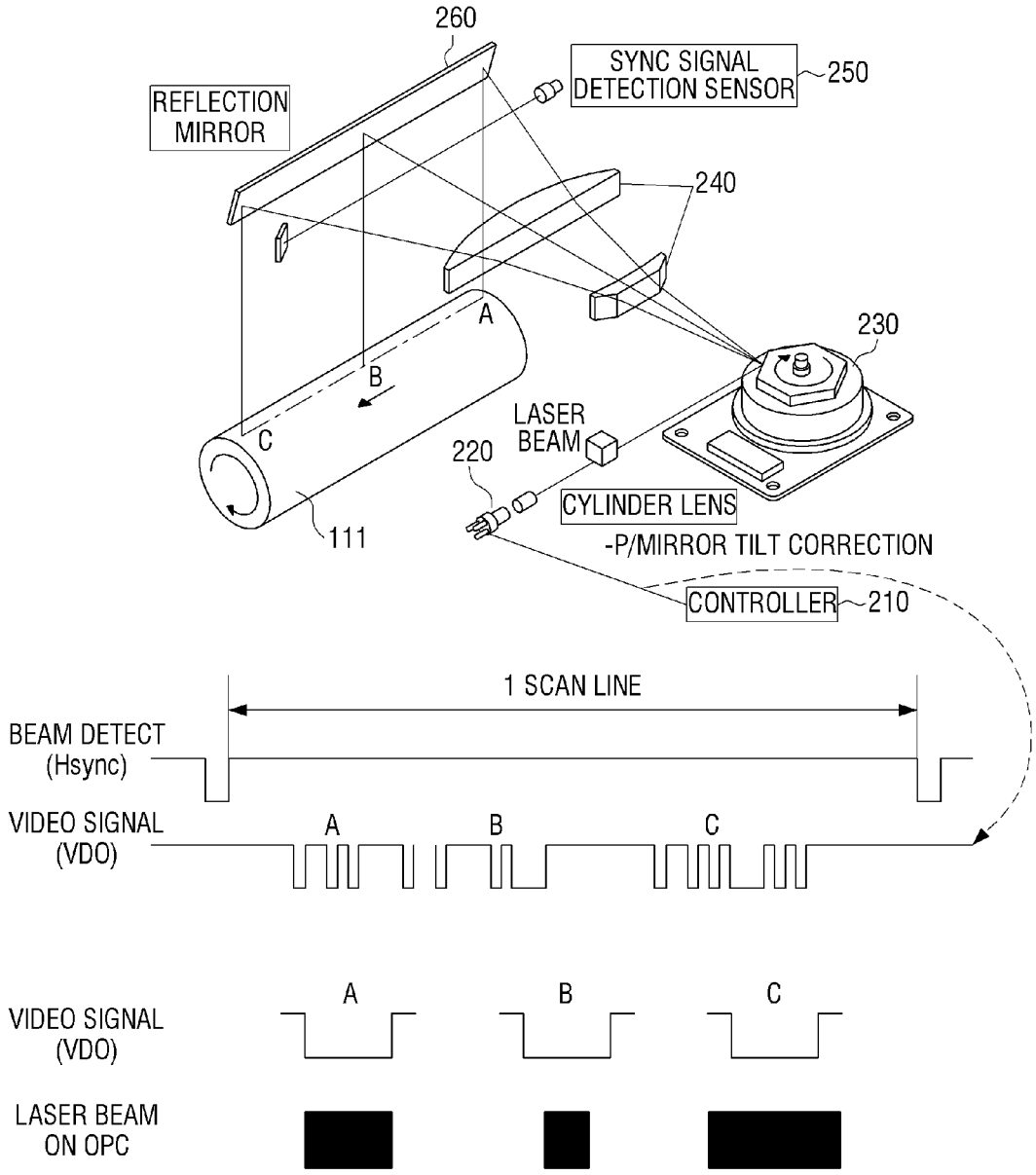
FIG. 4 is a diagram illustrating the detailed configuration of an LSU of FIG. 3.

FIG. 4 is a diagram illustrating the detailed configuration of an exposure device of FIG. 3.

Referring to FIG. 4, the exposure device 200 includes an exposure controller 210, a light source 220, a polygon mirror 230, a lens 240, a signal detector 250, and a reflecting mirror 260.

The exposure controller 210 provides a video signal that corresponds to print data to the light source 220 according to a sync signal that is generated by the signal detector 250, and controls the operation of the polygon mirror 230.

On the other hand, if color registration correction is performed through a process to be described later, the exposure controller 210 may generate a video signal according to the result of the color registration correction.

The light source 220 irradiates the polygon mirror 230 with the light according to the video signal that is provided from the exposure controller 210. The light source 220 may use LEDs.

The lens 240 may be a combination of one or more lenses, and may widely spread the light that is transferred from the polygon mirror 230 to provide the spread light to the reflecting mirror 260.

The reflecting mirror 260 irradiates the photosensitive drum 111 with the reflected light that is transferred from the lens 240.

As described above, the video signal that corresponds to the print data is reflected several times by the polygon mirror, the lens, and the reflecting mirror to be irradiated onto the photosensitive drum, and thus the color registration in the main scanning direction is not linear, but is non-linear by the lens tolerance, the mount position of the exposure device, or the change of scanning speed of the exposure device.

Specifically, as can be seen from a video signal VDO and a laser beam at three positions at a lower end in FIG. 4, the width of the laser beam that is irradiated onto the photosensitive drum in the main scanning direction may differ although the turn-on time of the laser beam is the same at the respective positions. Accordingly, the pixel width (pixel length in the main scanning direction) of an image that is formed on the photosensitive drum may also differ to cause the image that is printed on the printing paper to be distorted in the main scanning direction.

Further, since the degree of distortion differs for respective colors, registration between colors differs for respective positions in the main scanning direction.

Since the color registration in the main scanning direction is non-linear as described above, it is difficult to accurately correct the color registration in the main scanning direction only through the error correction at two or three positions as in the related art.

Accordingly, in the present disclosure, a method is proposed, which can correct the color registration that is caused by the distortion in the main scanning direction using the exposure controller 210 that can control the pixel width (or beam position) in the main scanning direction within respective laser beam scanning periods for colors.

First, in order to correct the color registration in the main scanning direction for colors, it is required to preferentially grasp what error occurs in the main scanning direction for colors.

However, as described above, since the color registration in the main scanning direction is non-linear, a lot of sampling data is required for main scanning positions. However, it is not preferable in terms of costs to be provided with a lot of expensive color registration sensors in order to secure the sampling data, and due to an actual size of the color registration sensor, it is not possible to arrange color registration sensors as many as necessary in the main scanning direction.

Figure 5:
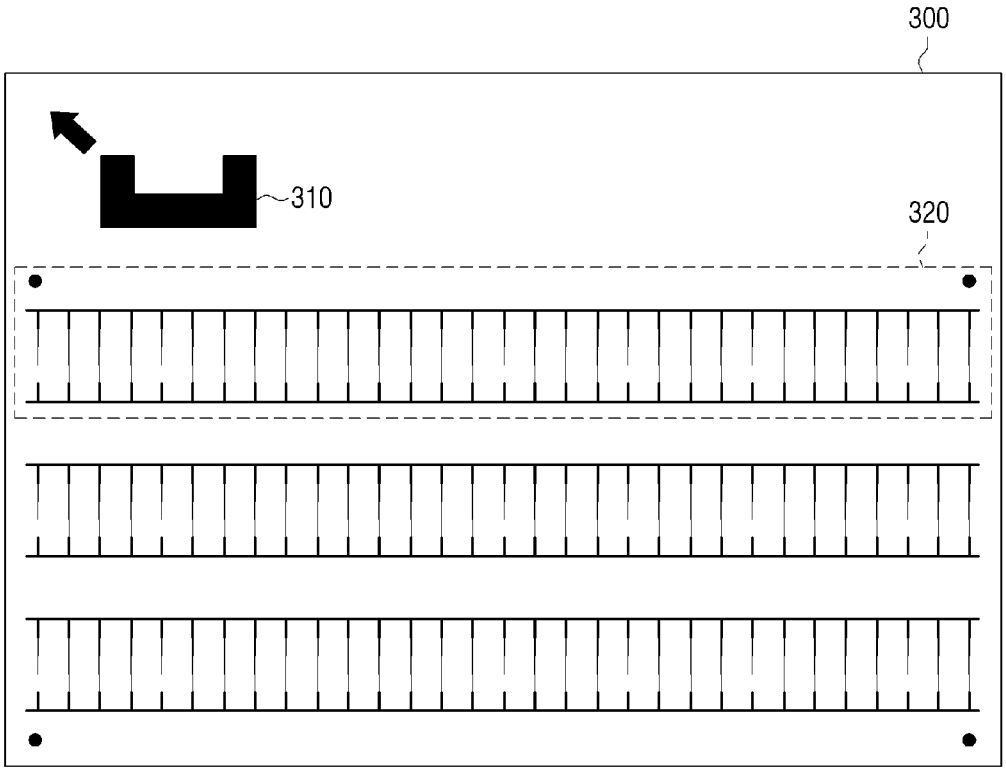
FIG. 5 is a diagram illustrating an example of a color chart of FIG. 5.

According to the present disclosure, errors for colors are sensed at a plurality of positions in the main scanning direction through printing of a color chart as shown in FIG. 5 and scanning of the printed color chart.

Further, the processor 130 may change the width of the pixels in the main scanning direction, which are formed on the photosensitive drums for colors using the sensed errors for the colors. On the other hand, during implementation, such an operation may be performed in the processor 130 itself, or may be performed by the exposure controller 210 that is in the image former 110 as described above. Such an operation will be described later with reference to FIG. 9.

FIG. 5 is a diagram illustrating an example of a color chart according to the present disclosure.

Referring to FIG. 5, a color chart 300 according to an embodiment of the present disclosure includes a first region 310 and a second region 320.

The first region is a region in which a predetermined shape is printed. The first region 310 is a region for confirming the degree of inclination with respect to X-axis and Y-axis.

The second region 320 is a region in which a plurality of lines that are arranged at predetermined intervals in the main scanning direction are printed. In an illustrated example, three lines are arranged. However, during implementation, only one or two lines may be arranged, or four or more lines may be arranged. The plurality of lines that constitute the second region 320 will be described later with reference to FIG. 6.

On the other hand, although not illustrated in FIG. 5, one of an English sentence, a figure, and a barcode, which can identify the image forming apparatus, may be printed on a predetermined region of the color chart 300. Specifically, the color registration in the main scanning direction may differ for devices, and in the case where a color chart of another image forming apparatus is applied to this image forming apparatus, the color registration may get worse on the contrary.

Accordingly, the processor 130 may control the image former 110 to print the color chart that includes information that can identify the device, preferably identify the information that is positioned in the scanned image, and precedingly identify whether the color chart has been printed in the same apparatus.

Further, since the registration state may differ according to time, not only information that can identify the apparatus but also information on the print time may be printed together, and the processor 130 may be implemented to use only the color chart that is printed within the predetermined time.

Figure 6:
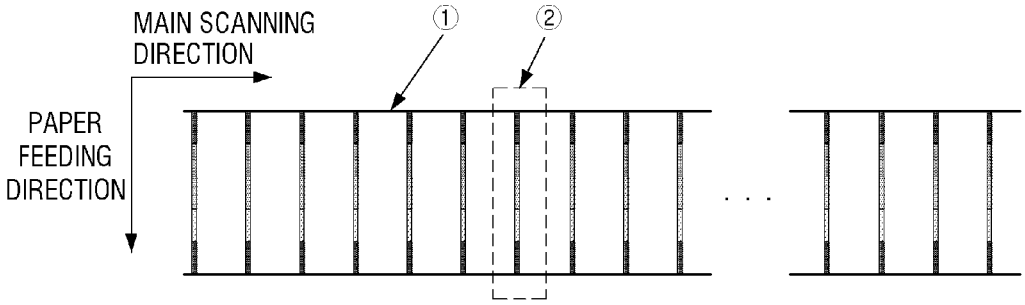
FIG. 6 is a diagram explaining the detailed shape of the color chart of FIG. 5.

FIG. 6 is a diagram explaining the detailed shape of the color chart of FIG. 5.

Referring to FIG. 6, the second region is composed of a plurality of lines. The plurality of lines that constitute the second region may be determined in a unit that can adjust timing of an exposure device and in a sampling number.

Here, the unit that can adjust the timing of the exposure device may correspond to respective changes of a polygon mirror, and may be, for example, 128 dots. The sampling number is the sampling number for each unit that can adjust the above-described timing, and may be a natural number in the range of 1 to 8.

For example, if the unit that can adjust the timing of the exposure device is 128 dots, and the sampling number is 2, 49 lines in total may be provided. Further, if the sampling number is 1, 25 lines may be provided, whereas if the sampling number is 3, 73 lines may be provided. However, since the unit that can adjust the timing for each image forming apparatus may differ, the above-described values are exemplary values, and may be optimized through experiment.

Further, the plurality of lines may be 5 sub-lines. Specifically, 5 sub-lines may have K, C, M, Y, and K colors in the predetermined sub-scanning interval unit. Here, the respective colors correspond to lines that are formed by different photosensitive drums. On the other hand, in the illustrated example, 5 sub-lines are provided, but 4 sub-lines (e.g., K, C, M, and Y) may also be provided. Here, the order of colors that constitute the respective sub-lines may be changed according to the arrangement type of the plurality of photosensitive drums in the image forming apparatus.

Likewise, color registration correction may be performed with at least two colors. This is because the correction method is to correct the positions of different colors while relatively comparing them. Color registration correction can be performed even if the color to be printed is different.

On the other hand, in the illustrated example, the reason why 5 sub-lines are provided, specifically, the reason why the first and fifth sub-lines have the same color K, is to compensate for skew values that are generated in the printing process or in the scanning process. The processor 130 may calculate the skew values of the paper (scanned image) using the first and fifth sub-lines, and may sense errors (specifically, errors in the main scanning direction of other color values on the basis of the K value) for colors on the basis of the calculated skew values.

Upper and lower portions of the plurality of sub-lines come in contact with the horizontal lines (i.e., horizontal to the main scanning direction) that are vertical to the sub-scanning direction. Such horizontal lines are horizontal lines for confirming the above-described skews.

Figure 7:
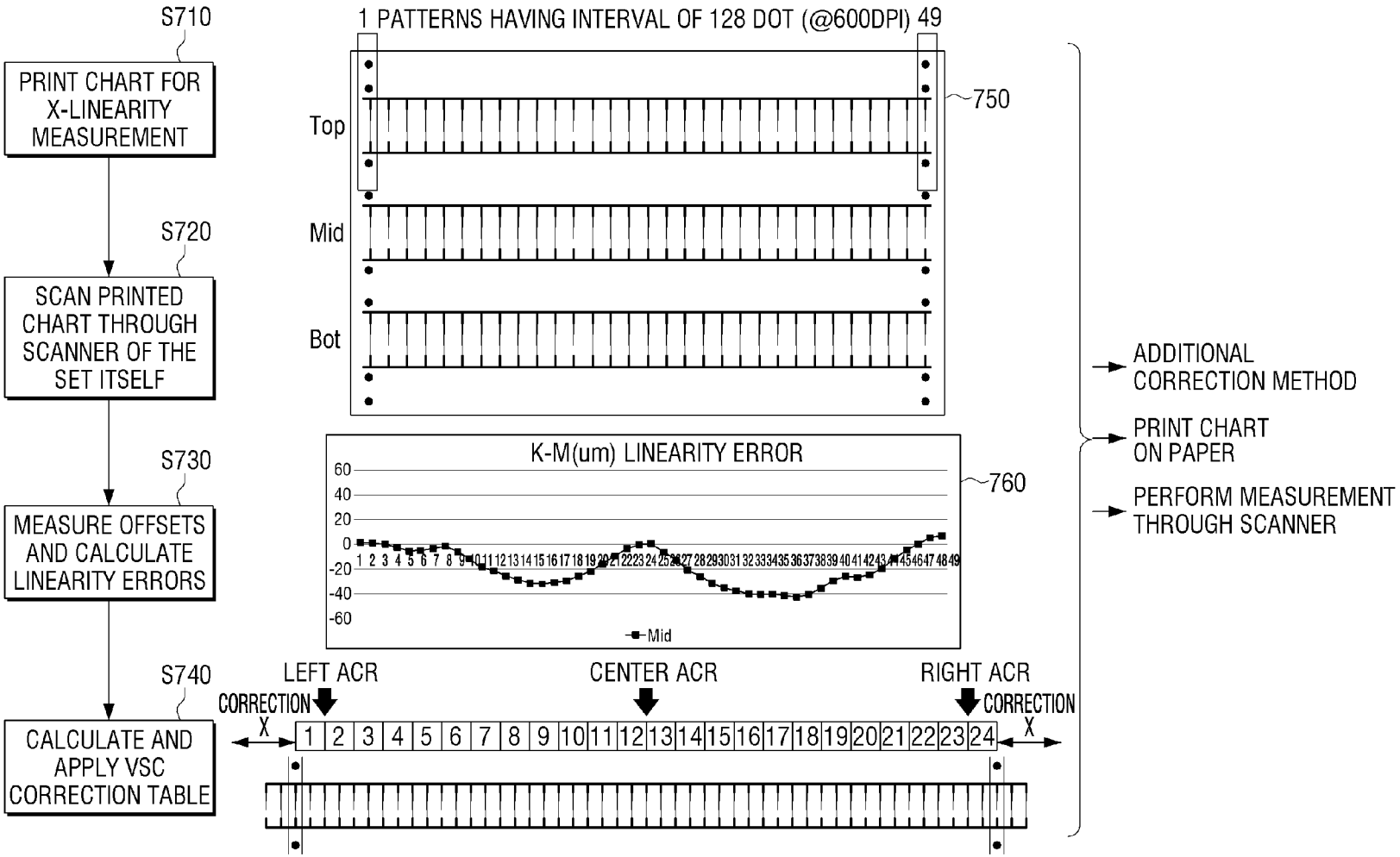
FIG. 7 is a diagram explaining a method for registration correction in a main scanning direction according to an embodiment of the present disclosure.

FIG. 7 is a diagram explaining a method for registration correction in a main scanning direction according to an embodiment of the present disclosure.

Referring to FIG. 7, first, a color chart for registration correction in a main scanning direction (x-axis) is printed (S710). Specifically, a color chart 300 or 750 as illustrated in FIG. 5 may be printed.

Then, the printed color chart is scanned using the scanner (S720). On the other hand, if the scanner is not provided in the image forming apparatus, the scan chart may be scanned through an external device, and a scanned image may be received from the external device.

Further, a plurality of positions in the main scanning direction and offsets for colors are measured using the scanned image, and linearity errors are calculated (S730). Specifically, a plurality of offsets for positions of other colors may be measured on the basis of the K color, and linearity errors of the other colors on the basis of the K color may be calculated.

Then, a video signal width correction table may be calculated on the basis of the calculated linearity error, and the calculated table may be applied to the exposure controller 210 (S740).

On the other hand, in the above-described example, it is described that the offset values are not used as they are, but the linearity errors are calculated and used. However, during implementation, the linearity errors are not calculated, but the video signal width correction table may be directly calculated using only the offset values. Specifically, in the present disclosure, it is described that the color registration in the main scanning direction is performed through a registration process using an ACR sensor. However, during implementation, only the color registration in the sub-scanning direction may be implemented to be performed using the ACR sensor.

Figure 8:
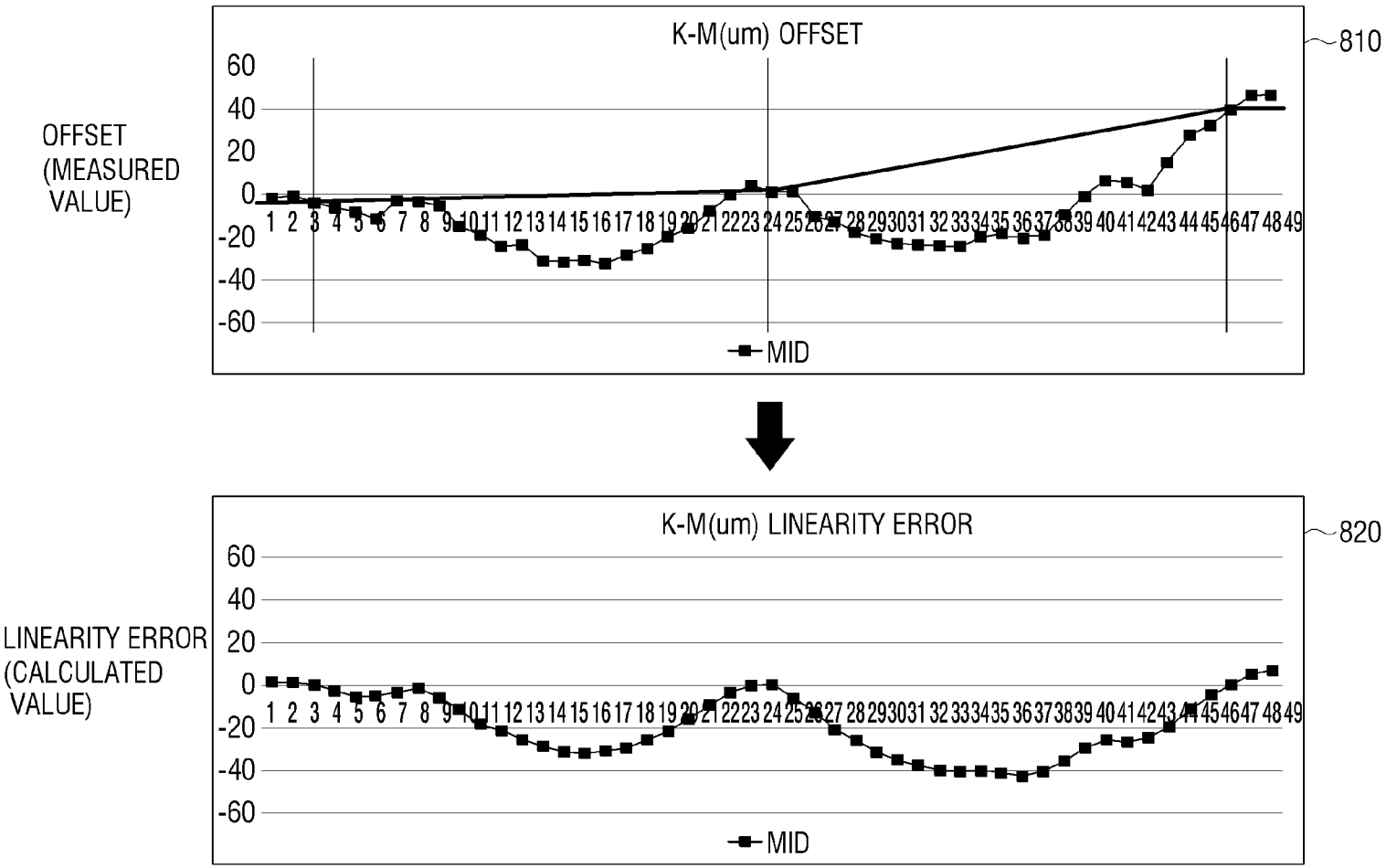
FIG. 8 is a diagram explaining a method for calculating a linearity error of FIG. 7.

FIG. 8 is a diagram explaining a method for calculating a linearity error of FIG. 7.

Referring to FIG. 8, errors between K color and M color for a plurality of positions (49 positions) in the main scanning direction may appear as shown as an upper end 810 of FIG. 8.

On the other hand, the errors in the main scanning direction at positions of the ACR sensor are to be corrected by the registration using the ACR, and a difference between a straight line between ACR positions and an actual offset may be calculated as the linearity error. The corresponding calculation values are as shown as a lower end 820 of FIG. 8.

According to the present disclosure as described above, the registration correction is improved even with respect to the positions in the main scanning direction, which has not been improved in the method in the related art, and thus the registration effect in the main scanning direction can be improved. Experimental results for this will be described later with reference to FIGS. 10 to 13.

Figure 9:
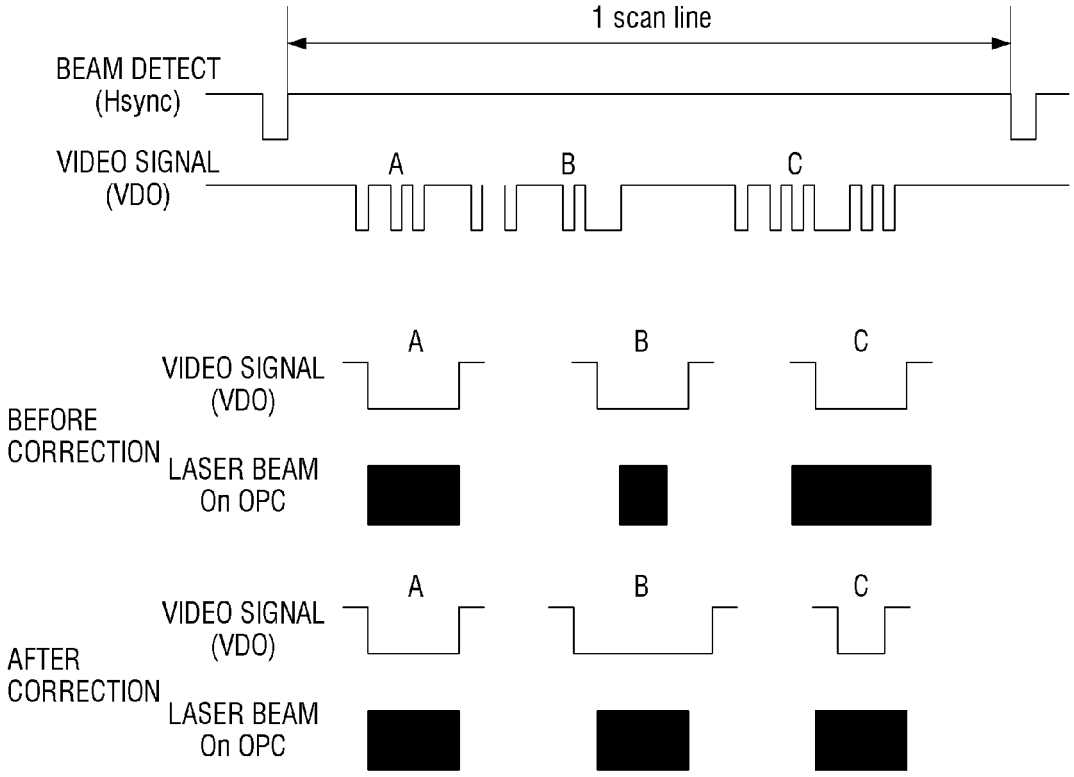
FIG. 9 is a diagram explaining an example of signals in the case where a linearity error is calculated.

FIG. 9 is a diagram explaining an example of signals in the case where a linearity error is calculated.

Referring to FIG. 9, if the linearity errors for a plurality of positions in the main scanning direction are calculated through the above-described process, the width in the main scanning direction in the photo sensors that correspond to C, M, and Y colors may be changed on the basis of the calculated linearity errors. Accordingly, as illustrated in FIG. 9, the width in the main scanning direction that is applied for each pixel is changed, and accordingly, pixels formed at the respective positions become equal to each other for the respective positions.

Accordingly, the width in the main scanning direction of pixels that are formed on the photosensitive drums for colors may be changed using the sensed errors for colors. On the other hand, during implementation, such an operation may be performed by the processor 130 itself, or may be performed by the exposure controller 210 in the image former 110. Such an operation will be described later with reference to FIG. 9.

FIGS. 10 to 13 are diagrams explaining experimental data in the case where a linear error is corrected.

Figure 10:
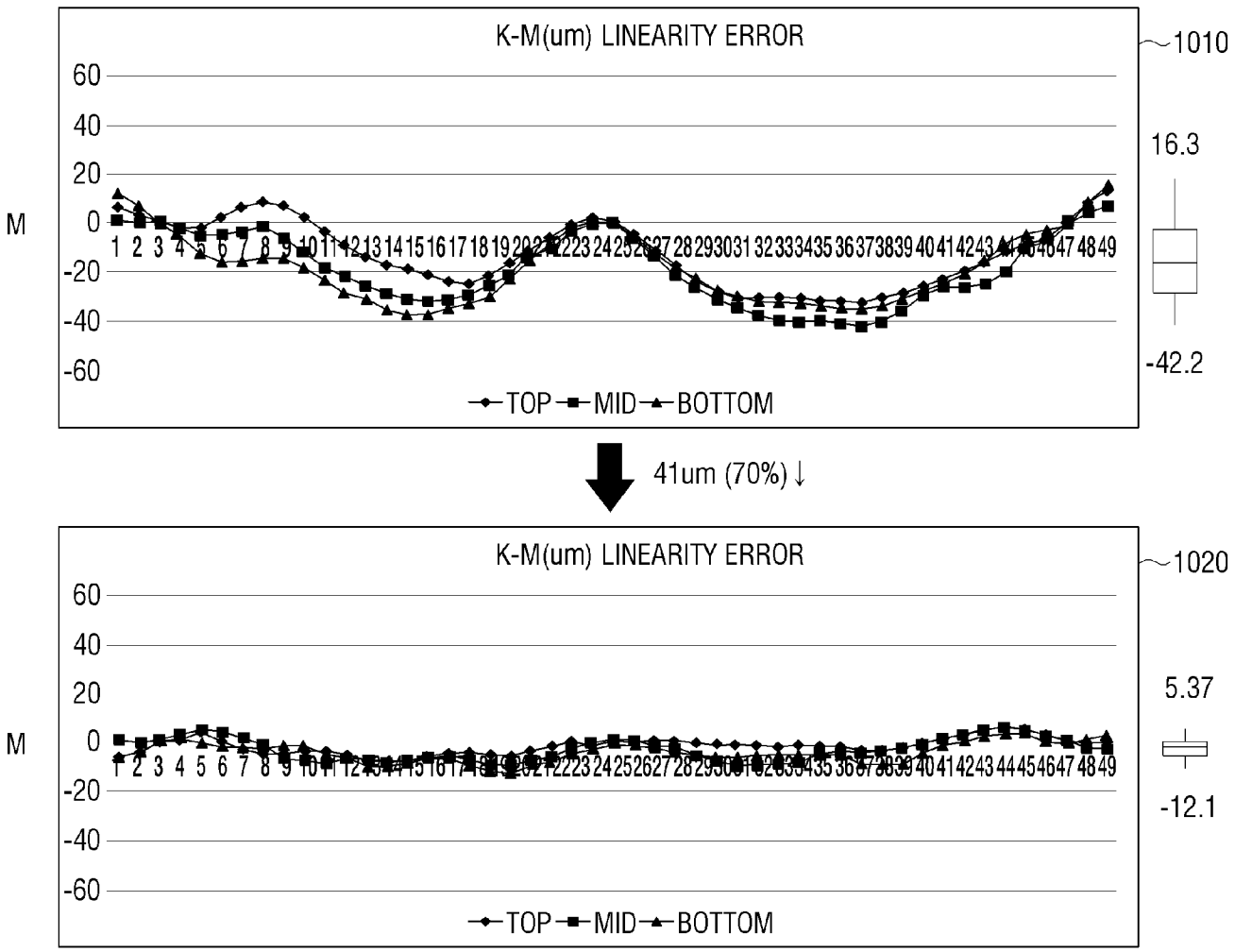
FIGS. 10 to 13 are diagrams explaining experimental data in the case where a linear error is corrected.
Figure 11:
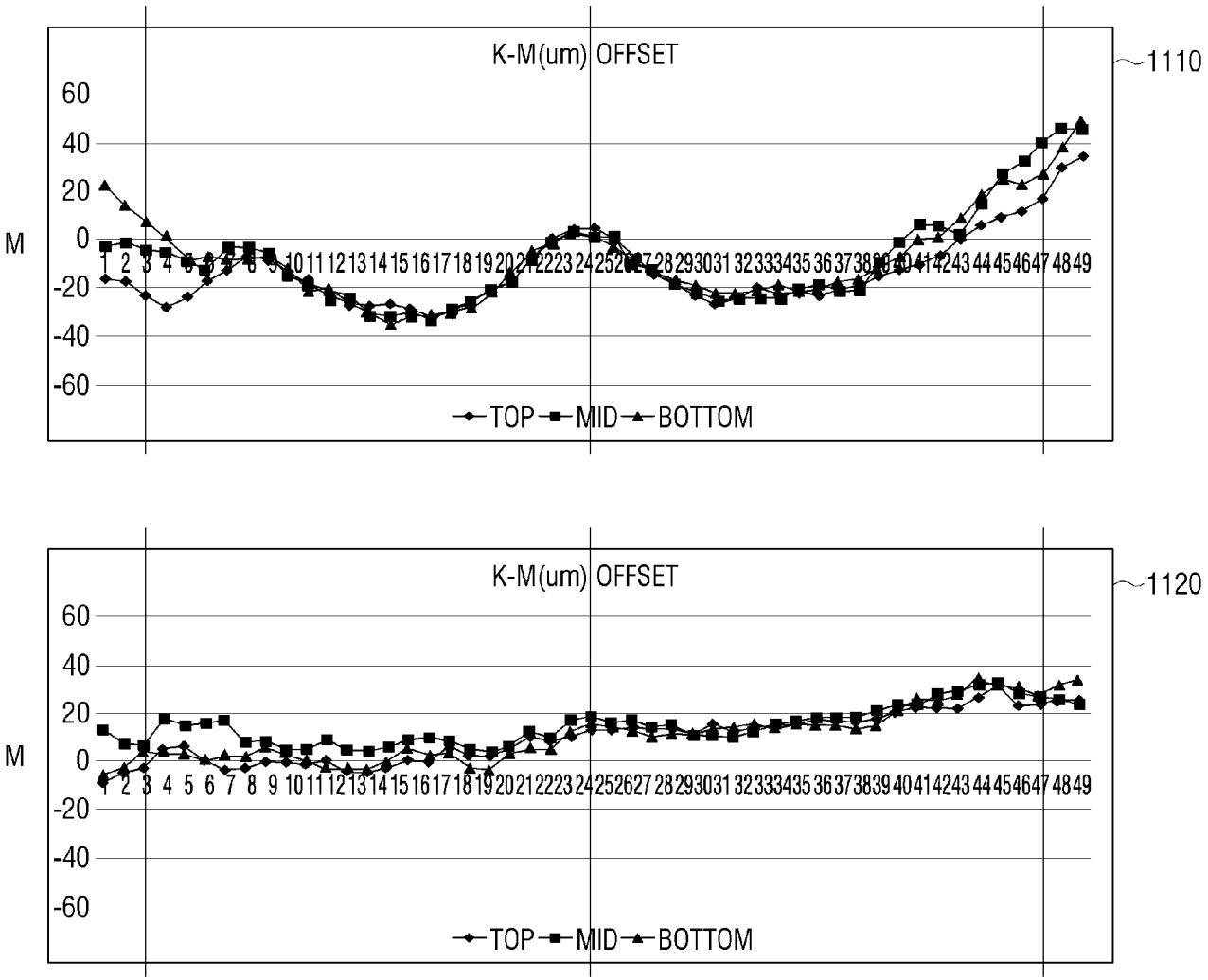

Specifically, FIGS. 10 and 11 are diagrams explaining improvement effects in the image forming apparatus that can print on a printing paper of A3 at maximum.

Referring to FIG. 10, before the present disclosure is applied (1010), there may be errors in the range of 16.3 to −42.2 μm with respect to the plurality of positions in the main scanning direction, but after the present disclosure is applied (1020), it can be confirmed that the errors are reduced to the range of 5.37 to −12.1 μm.

FIG. 11 shows experimental values in an image forming apparatus that is different from the image forming apparatus of FIG. 10. Referring to FIG. 11, it can be confirmed that the errors for colors at the plural positions are reduced after the application of the present disclosure (1120) rather than before the application of the present disclosure (1110).

Figure 12:
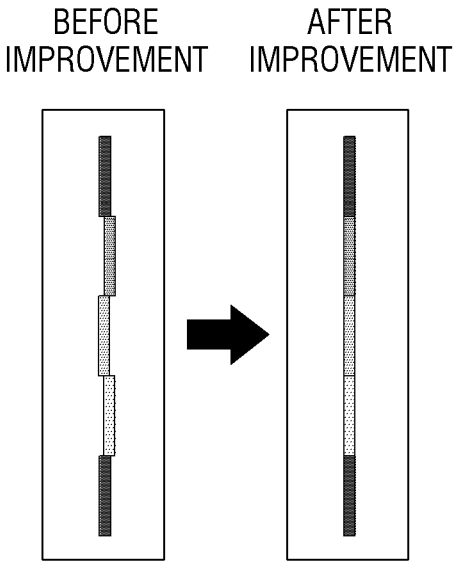

FIG. 12 is an enlarged view of one line in a color chart as illustrated in FIG. 5. Before application of the present disclosure, there exists an error in the main scanning direction with respect to one position, whereas after application of the present disclosure, it can be confirmed that the error in the main scanning direction is considerably reduced.

Figure 13:
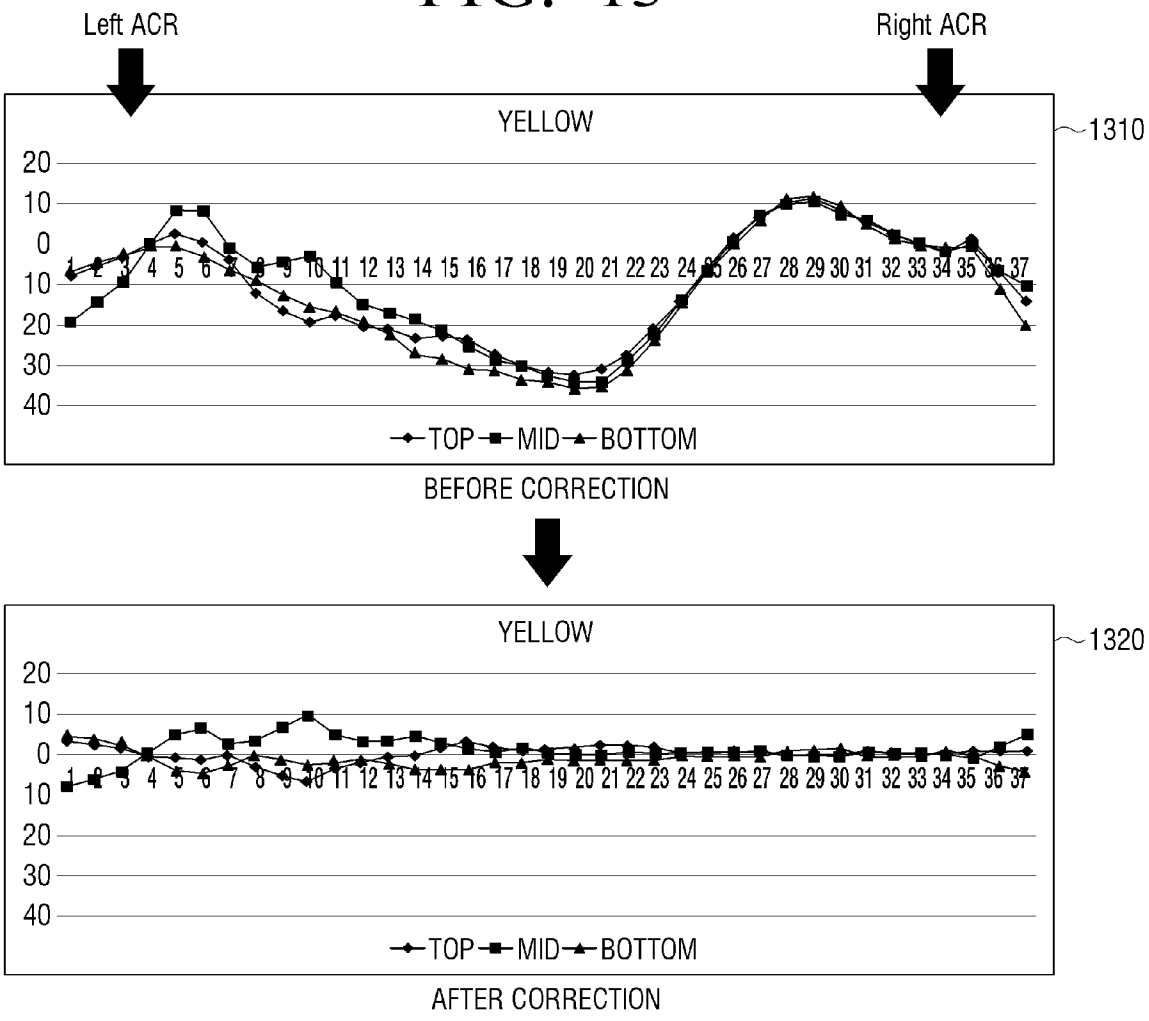

FIG. 13 is a diagram explaining improvement effects in the image forming apparatus that can print on a printing paper of A4 at maximum.

Referring to FIG. 13, in the case of the image forming apparatus that prints on the printing paper of A4, the width in the main scanning direction is different from that on the printing paper of A3, and the errors are sensed at only 37 positions. Even in this case, it can be confirmed that the error in the main scanning direction is considerably reduced after the application of the present disclosure (1320) rather than before the application of the present disclosure 1310.

Figure 14:
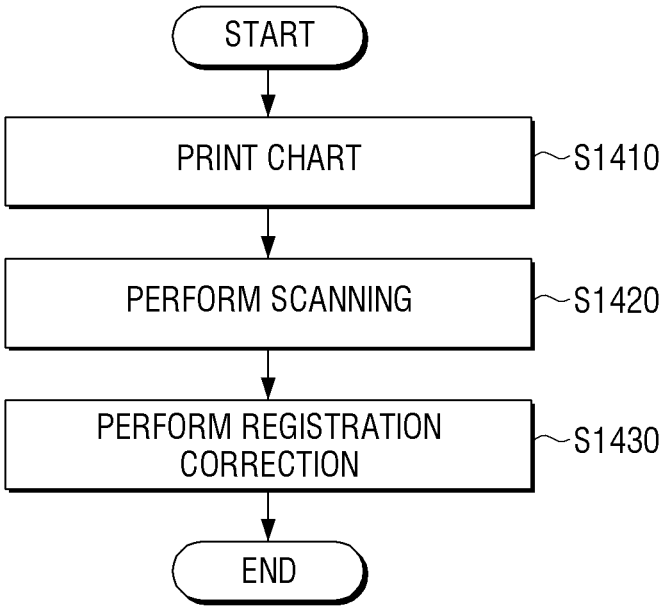
FIG. 14 is a flowchart explaining a method for registration correction according to an embodiment of the present disclosure.

FIG. 14 is a flowchart explaining a method for registration correction according to an embodiment of the present disclosure.

Referring to FIG. 14, a color chart for registration is printed (S1410). Specifically, a color chart having a plurality of lines which are arranged at predetermined intervals in a main scanning direction and are vertical to the main scanning direction is printed. Here, each of the plurality of lines is composed of sub-lines that are vertical to one another of K, C, M, Y, and K colors.

A printing paper on which the color chart is printed is scanned (S1420). On the other hand, during implementation, if a scanner is not provided in the image forming apparatus, it may be implemented in a manner that a printing paper on which a color chart is printed is scanned by another device, and the scanned image is received from the corresponding device. Further, it may be implemented in a manner that a color chart that is printed by an electronic device (e.g., smart phone) that is provided with an image pickup device other than the scanner is picked up and is transferred to the image forming apparatus.

Further, registration correction is performed using the scanned color chart (S1430). Specifically, the registration correction for the different photosensitive drums for a plurality of positions in the main scanning direction that correspond to the plurality of lines may be performed using the scanned color chart.

Accordingly, the method for registration correction according to this embodiment can correct the errors (i.e., errors due to non-linearity of an LSU optical system) in the main scanning direction, and thus it becomes possible to perform color printing with more improved image quality. The method for registration correction as shown in FIG. 14 may be executed on the image forming apparatus having the configuration as shown in FIG. 1 or 2, and may be executed even on an image forming apparatus having other configurations.

Further, the method for registration correction as described above may be implemented by at least one execution program for executing the method for registration correction, and such an execution program may be stored in a computer readable recording medium.

Accordingly, respective blocks according to the present disclosure may be executed as a computer readable code on the computer readable recording medium. The computer readable recording medium may be a device that can store data that can be read by a computer system.

Figure 15:
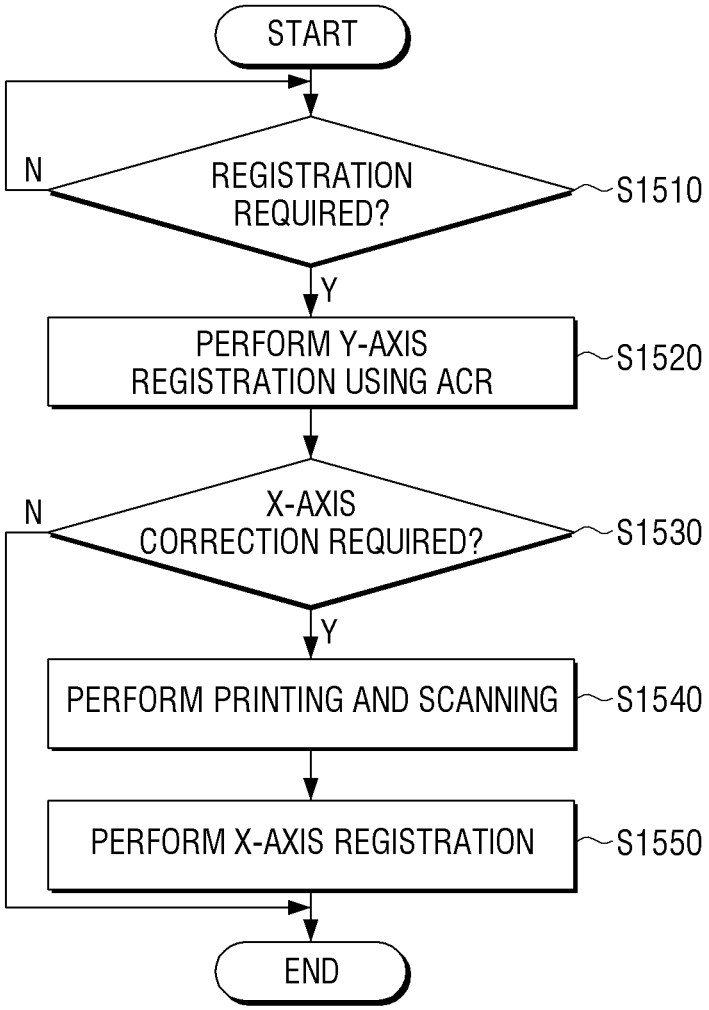
FIG. 15 is a flowchart explaining a method for registration correction according to another embodiment of the present disclosure.

FIG. 15 is a flowchart explaining a method for registration correction according to another embodiment of the present disclosure.

Referring to FIG. 15, it is determined whether registration is required (S1510). Specifically, in the case where consumables are re-installed or the number of printing sheets exceeds a predetermined number of sheets, it is automatically determined that the registration is required. In this case, it may be displayed that the registration is required, and in response to such a display, a registration command may be input from a user. On the other hand, during implementation, such a display operation may be omitted. Further, Y-axis registration to be described later may be automatically performed, and only in the case of performing X-axis registration, the above-described display operation may be performed.

If the registration is required (S1510-Y), the registration using an ACR is performed. Specifically, the registration for a plurality of colors may be performed using registration sensors. Accordingly, the registration in the Y-axis direction (sub-scanning direction) and a color registration for a region in which the ACR is positioned in the X-axis direction may be performed.

Thereafter, it is determined whether correction of the X-axis registration is required (S1530). Specifically, in the case where the registration using the ACR has been performed, but the error in the X-axis direction is not great, it may be determined that the registration correction is not required. In contrast, if the registration command is input from the user or the error in the X-axis direction in which the ACR sensor is positioned is somewhat great, it may be determined that the color registration according to the present disclosure is required.

If it is determined that the color registration in the X-axis direction is required (S1530-Y), the color chart may be printed and then scanned (S1540), and the color registration in the main scanning direction may be performed using the scanned color chart (S1550).

On the other hand, in the illustrated example, it is described that the color registration according to the present disclosure is performed after the color registration using a general ACR sensor is performed. However, during implementation, the color registrations may be performed in reverse order. For example, if there is a great error for a region in which the ACR sensor is positioned as the result of performing the color registration according to the present disclosure, the color registration using the ACR sensor may be automatically performed.

Accordingly, the method for registration correction according to this embodiment can correct the errors (i.e., errors due to non-linearity of an LSU optical system) in the main scanning direction, and thus it becomes possible to perform color printing with more improved image quality. The method for registration correction as shown in FIG. 15 may be executed on the image forming apparatus having the configuration as shown in FIG. 1 or 2, and may be executed even on an image forming apparatus having other configurations.

Further, the method for registration correction as described above may be implemented by at least one execution program for executing the method for registration correction, and such an execution program may be stored in a computer readable recording medium.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. An image forming apparatus comprising:

an image former including a plurality of photosensitive drums to print, on a printing paper, a plurality of lines that are oriented perpendicular to a main scanning direction of the image former to be arranged at predetermined intervals along the main scanning direction, each line of the plurality of lines including a plurality of colored sub-lines oriented perpendicular to the main scanning direction to be formed along a sub-scanning direction of the image former by corresponding photosensitive drums, and at least two sub-lines among the plurality of sub-lines printed using a different respective one of the plurality of photosensitive drums;

a scanner to scan the printing paper, on which the plurality of lines is printed, to obtain a scanned image of the plurality of lines; and at least one processor to perform color registration correction using the scanned image.

2. The image forming apparatus as claimed in claim 1, wherein the at least one processor performs the registration correction for the plurality of photosensitive drums for a plurality of positions along the main scanning direction that respectively correspond to the plurality of lines, by using the scanned image.

3. The image forming apparatus as claimed in claim 1, wherein for each of the plurality of lines, the respective sub-lines include first to fifth sub-lines sequentially arranged along the sub-scanning direction, and the image former prints the first and fifth sub-lines on the printing paper using a same photosensitive drum among the plurality of photosensitive drums.

4. The image forming apparatus as claimed in claim 3, wherein the at least one processor:

calculates skew values of the plurality of lines using the first and fifth sub-lines, and performs the registration correction for the plurality of photosensitive drums based on the calculated skew values.

5. The image forming apparatus as claimed in claim 3, wherein the plurality of photosensitive drums includes a photosensitive drum that corresponds to a black color, and the first and fifth sub-lines are both formed by the photosensitive drum that corresponds to the black color.

6. The image forming apparatus as claimed in claim 5, wherein the at least one processor:

detects errors in the sub-lines based on the first and fifth sub-lines, and based on the detected errors, corrects irradiation positions of photo sensors that correspond to C, M, and Y colors, respectively, for a plurality of positions along the main scanning direction that correspond to the plurality of lines.

7. The image forming apparatus as claimed in claim 1, wherein the image former prints horizontal lines that are respectively in contact with upper and lower portions of the plurality of lines and are vertical to the sub-scanning direction.

8. The image forming apparatus as claimed in claim 1, wherein the plurality of lines are 49 lines.

9. The image forming apparatus as claimed in claim 1, wherein a number of the plurality of lines is determined based on a quantity of a unit in which timing of an exposure device of the image forming apparatus is adjustable, and based on a sampling number for each of the units.

10. The image forming apparatus as claimed in claim 9, wherein the sampling number is a natural number in a range of 1 to 8.

11. The image forming apparatus as claimed in claim 1, wherein the image former prints a predetermined shape at a position that is spaced apart from the plurality of lines.

12. The image forming apparatus as claimed in claim 1, wherein the image former prints at least one of an English sentence, a figure, and a barcode, which indicates an identity the image forming apparatus, together with the plurality of lines.

13. A method for color registration by an image forming apparatus, the method comprising:

printing, on a printing paper by using a plurality of photosensitive drums of an image former, a plurality of lines that are oriented perpendicular to a main scanning direction of the image former to be arranged at predetermined intervals along the main scanning direction, each line of the plurality of lines including a plurality of colored sub-lines oriented perpendicular to the main scanning direction to be formed along a sub-scanning direction of the image former by corresponding photosensitive drums, and at least two sub-lines among the plurality of sub-lines printed using a different respective one of the plurality of photosensitive drums;

scanning the printing paper, on which the plurality of lines is printed, to obtain a scanned image of the plurality of lines; and performing color registration correction using the scanned image.

14. The method as claimed in claim 13, wherein the performing the correction performs the registration correction for the plurality of photosensitive drums for a plurality of positions along the main scanning direction that respectively correspond to the plurality of lines, by using the scanned image.

15. The method as claimed in claim 13, wherein for each of the plurality of lines, the respective plurality of sub-lines includes first to fifth sub-lines sequentially arranged along the sub-scanning direction, and the printing prints the first and fifth sub-lines on the printing paper using a same photosensitive drum among the plurality of photosensitive drums.

16. The method as claimed in claim 15, wherein the performing the registration correction comprises:

calculating skew values of the plurality of lines using the first and fifth sub-lines, and performing the registration correction for the different photosensitive drums based on the calculated skew values.

17. The method as claimed in claim 15, wherein the plurality of photosensitive drums includes a photosensitive drum that corresponds to a black color, and the first and fifth sub-lines are both formed by the photosensitive drum that corresponds to the black color.

18. The method as claimed in claim 17, wherein the performing the registration correction comprises:

detecting errors in the sub-lines based on the first and fifth sub-lines, and based on the detected errors, correcting irradiation positions of photo sensors that correspond to C, M, and Y colors, respectively, for a plurality of positions in the main scanning direction that correspond to the plurality of lines.

19. The method as claimed in claim 13, wherein the printing prints horizontal lines that are respectively in contact with upper and lower portions of the plurality of lines and are vertical to the sub-scanning direction.

20. The method as claimed in claim 13, wherein a number of the plurality of lines is determined based on a quantity of a unit in which timing of an exposure device used to print the plurality of lines is adjustable, and based on a sampling number for each of the units.

* * * * *